US005584271A

United States Patent [19]

Sakata

[11] Patent Number: 5,584,271

[45] Date of Patent: Dec. 17, 1996

[54] VALVE STEM SEAL

[75] Inventor: David Sakata, Livonia, Mich.

[73] Assignee: Freudenberg-NOK General Partnership, Plymouth, Mich.

[21] Appl. No.: 557,460

[22] Filed: Nov. 14, 1995

[51] Int. Cl.[6] ..... F01L 3/08

[52] U.S. Cl. ..... 123/188.6; 251/332

[58] Field of Search ..... 123/188.6; 251/330, 251/332; 277/31, 178

[56] References Cited

U.S. PATENT DOCUMENTS

| | | | |
|---|---|---|---|
| 2,157,865 | 7/1939 | Robertson et al. . | |
| 2,207,400 | 7/1940 | Gass . | |
| 2,418,674 | 4/1947 | Steiner . | |
| 3,162,185 | 12/1964 | Knoblock . | |
| 3,306,621 | 2/1967 | Fisher . | |
| 3,554,180 | 1/1971 | Lesser . | |
| 3,554,562 | 1/1971 | Davis, Jr. . | |
| 4,325,558 | 4/1982 | Poggio | 123/188.6 |
| 4,706,967 | 11/1987 | Ochsner | 123/188.6 |
| 4,798,181 | 1/1989 | Beer et al. . | |
| 4,909,202 | 3/1990 | Binford et al. . | |
| 4,947,811 | 8/1990 | Binford . | |
| 5,460,139 | 10/1995 | Marlin et al. | 123/188.6 |

FOREIGN PATENT DOCUMENTS

| | | | |
|---|---|---|---|
| 0021874 | 5/1980 | European Pat. Off. . | |
| 2623850 | 6/1989 | France | 123/188.6 |

*Primary Examiner*—Erick R. Solis
*Attorney, Agent, or Firm*—Dinnin & Dunn, P.C.

[57] ABSTRACT

A valve stem seal for use in an internal combustion engine. The valve stem seal includes a leak resistant plastic seal member located at the bottom of a valve guide. The valve stem seal is secured in place around the bottom of the valve guide by a metallic outer case having a cylindrical shape. The valve stem seal is in continuous engagement with a reciprocating valve stem on the bottom portion of the valve guide system.

15 Claims, 1 Drawing Sheet

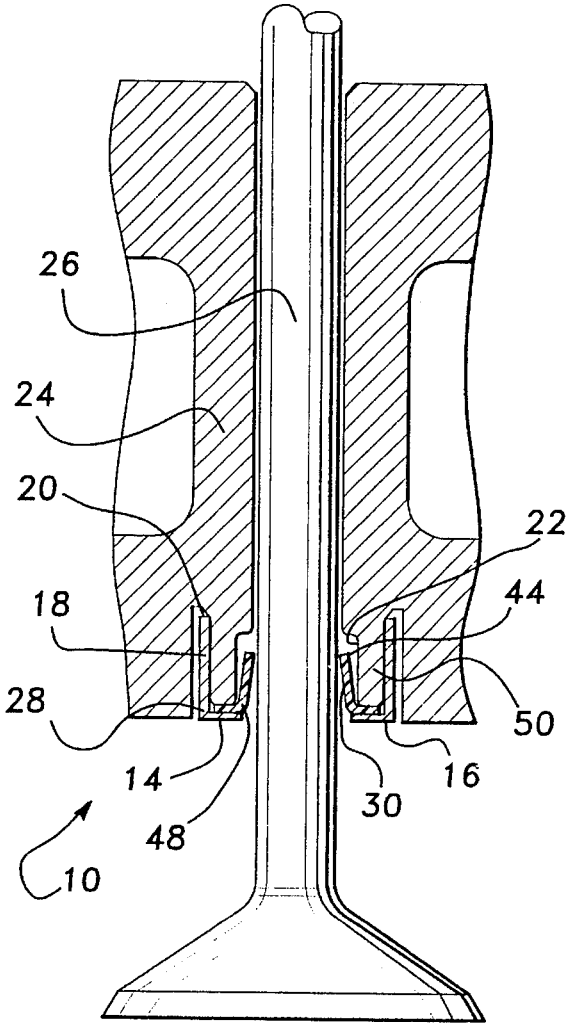
Fig-1
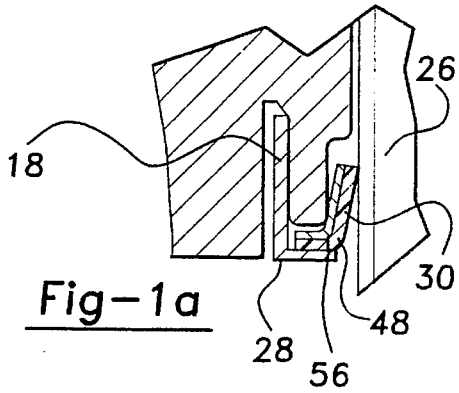
Fig-1a
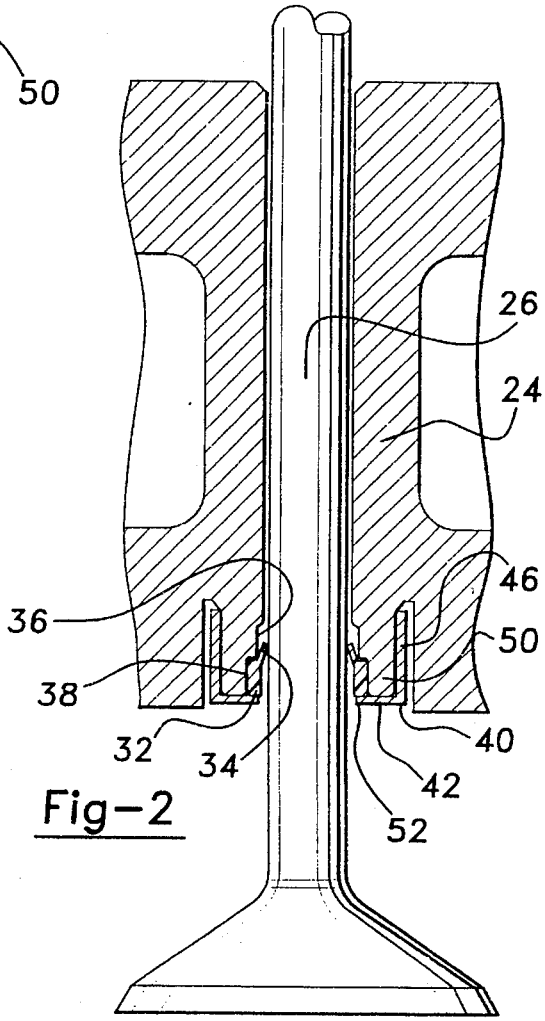
Fig-2
Fig-2a
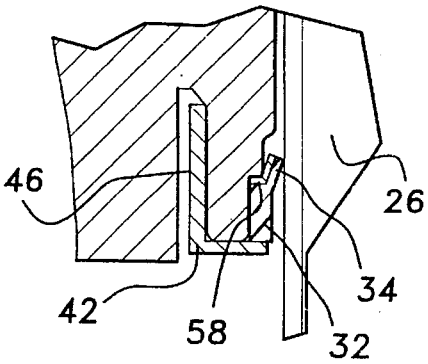

VALVE STEM SEAL

BACKGROUND OF THE INVENTION

1. Field of the Invention

The present invention relates to valve stem seals, and more particularly to a valve stem seal for use on a valve guide.

2. Description of Related Art

Numerous valve stem seals have been developed for internal combustion engines. Numerous attempts have also been made to create a low friction seal which resists wear in high temperature environments. Various materials have been tried such as ceramics, metal, copper, bronze, and/or brass alloys. An example of a prior art valve guidance seal member can be found in U.S. Pat. No. 4,798,181.

It is desirable in an internal combustion engine to maintain a uniform film of lubricating oil between the valve stem and the valve guide to reduce wear, extend durability and promote a reduced friction environment thus conserving or saving energy and reducing heat of operation. When the valve guide becomes worn the axis of the valve may become skewed to the axis of the guide and cause the valve to bind within the guide thus increasing engine noise and engine wear. Also, the worn guide and stem may cause accelerated wear to the seal, causing higher oil consumption and interfere with engine emissions. While there is a need to lubricate the valve stem, the problem of oil leaking into the combustion chamber via the valve stem/valve guide interface must also be considered. Increased oil leakage results in excessive smoking and/or high oil consumption within the internal combustion engine. A further factor which compounds all the above problems, is that the valve stem operates in a high temperature environment which may cause the oil to carbonize and reduce the effective life of prior art valve stem seals.

Therefore, it is desirable to develop a valve stem seal which is capable of overcoming the above-mentioned disadvantages of previous valve stem seals.

SUMMARY OF THE INVENTION

One object of the present invention is to provide a leak resistant seal at the bottom of a valve guide within an internal combustion engine.

To achieve the foregoing object the present invention is a valve stem seal for use on a valve guide within an internal combustion engine. The valve stem seal is used on the bottom portion of the valve guide. The valve stem seal is circular and ring-like in appearance and is placed about the inner portion of the valve guide assembly. The valve stem seal is secured into place with a metallic or plastic casing which is press fit to the outer periphery of the valve guide. The valve stem seal includes a single annular lip which is in constant contact with a reciprocating valve stem. The use of a plastic or PTFE type material for the valve stem seal will create a long-lasting low friction sealing engagement for the valve stem.

One advantage of the present invention is that it will reduce the overall weight of the valve stem seal.

Another advantage of the present invention is that it creates a leak resistant seal at the bottom of the valve guide, allowing for good lubrication of the guide I.D. and valve stem without excessive oil leakage at the guide.

A further advantage of the present invention is that it will reduce the cost of manufacturing and assembling the valve guide system.

Another advantage of the present invention is that it can resist the high operating temperatures that the valve stem is subject to.

Other objects, features and advantages of the present invention will become apparent from the subsequent description and appended claims taken in conjunction with the accompanying drawings.

BRIEF DESCRIPTION OF THE DRAWINGS

FIG. 1 shows a leak resistant valve seal according to the present invention.

FIG. 1A shows an alternate embodiment of a leak resistant valve seal.

FIG. 2 shows an alternate embodiment of the valve seal according to the present invention.

FIG. 2A shows an alternate embodiment of the valve seal.

DESCRIPTION OF THE PREFERRED EMBODIMENT(S)

Referring to FIG. 1, a valve seal assembly 10 according to the present invention is shown. The valve seal assembly 10 includes a valve stem seal 30 for use with a valve guide 24. The valve stem seal 30 is located in either the exhaust chamber or an intake chamber of an internal combustion engine. The valve stem seal 30 must be capable of withstanding very high temperatures.

The valve stem seal 30 is used at the bottom portion 30 of the valve seal assembly 10. The valve stem seal 30 is circumferential and ring-like in appearance. The valve stem seal 30 has an outwardly extending flange 14. In the preferred embodiment the cross-section of the valve stem seal 30 has a generally L-shaped appearance when it is engaged with the valve stem 26 within the valve guide 24. The valve stem seal has a flex point 48 from where a radial force: is projected towards the valve stem 26. This force keeps the seal 30 in constant engagement with the reciprocating valve stem 26. The valve stem seal 30 is located upon the valve guide 24. The flange 14 of the valve stem seal 30 is located and centered upon the valve guide 24. The valve stem seal 30 is set at an inward angle towards the valve stem 26. This allows for a continuous engagement of the valve stem seal 30 along the reciprocating valve stem 26.

In the preferred embodiment the valve stem seal 30 is made of a polytetrafluoroethylene (PTFE) compound material i.e. Teflon® plastic material. This PTFE material is capable of being molded into any shape or form. The PTFE material is used because it is a low friction material which is capable of withstanding high heat and also possesses the hardness properties needed to withstand the excessive wear the seal will be subject to. It should be noted that other types of high temperature resistant plastics, hard plastics or composites may also be used. The valve stem seal 30 includes at least one annular lip 44 which will be in continuous contact with the valve stem 26.

The valve stem seal 30 extends down into an indentation or reduced neck portion 22 of the inner wall of the valve guide 24. The valve stem seal 30 is secured to the valve guide 24 with a rigid outer cylinder or case 28. The rigid cylinder 28 includes an inwardly extending flange 16 at one end which is in contact with flange 14 of the seal 30. The valve guide 24 also includes an indentation or reduced shoulder portion 20 on the outer periphery to accommodate the rigid cylinder 28. The rigid cylinder 28 centers the valve stem seal 30 upon the valve guide 24 to ensure the valve stem seal 30 is aligned with the valve stem 26. The rigid cylinder 28 may be either press fit, bonded, welded or secured by other suitable means to the valve guide 24. The valve stem seal 30 may also be bonded with a bonding cement to the rigid cylinder 28 and/or directly to the valve guide 24. The addition of a plastic or PTFE valve stem seal at the bottom of the valve guide 24 reduces engine wear and reduces engine oil leaking into the combustion chambers of the internal combustion engine. With the use of PTFE for the valve stem seal 30 the sealing area around the valve stem 26 is nearly a zero-leak sealing area, only a minute amount of oil is able to penetrate this barrier. The valve stem seal 30 may include a finger spring 56 or other type of spring to insure the seal is in continuous contact with the valve stem 26, see FIG. 1A.

FIG. 2 shows an alternate embodiment of a valve stem seal 32 according to the present invention. In this embodiment the valve stem seal 32 has a circumferential ring-like body. It also includes an appendage 34 which is offset at an inner descending angle from the inside surface of the seal 32 to create continuous contact with the valve stem 26. The appendage 34 is located at a top corner 52 of the seal 32. The seal 32 is also made of a hard plastic low friction type material or other type of composite material or hard plastic. The preferred material in the alternate embodiment is polybenzimidazole (PBI). PBI is a composite molded material capable of resisting high temperatures. The seal 32 is press fit onto the valve guide 24 or secured by any other bonding agent that would bond the plastic material to the metal guide. The outer metal case 40 is also used to further secure the plastic seal 32 within the valve guide 24 as it was in the preferred embodiment.

The valve guide 24 in the alternate embodiment includes two inner descending edges or two reduced neck portions (36, 38) upon which the valve stem seal 32 will be placed for secure attachment to the valve guide 24. The first inner descending edge or first reduced neck portion 38 will be used to locate the main portion of the valve stem seal 32 while the second descending edge or second reduced neck portion 36 is used to house the offset appendage 34 which is in contact with the valve stem 26. The valve stem seal 32 may include a finger spring 58 or other type of spring to insure the seal is in continuous contact with the valve stem 26, see FIG. 2A.

It should be noted that the outer casing 40 can be made of a metal material or of a plastic material depending on the needs and environment in which the valve stem seal will be used.

The present invention has been described in an illustrative manner. It is to be understood that the terminology which has been used is intended to be in the nature of words of description rather than limitation.

Many modifications and variations of the present invention are possible in light of the above teachings. Therefore, within the scope of the appended claims the present invention may be practiced other than as specifically described.

What is claimed is:

1. A valve stem seal for use in an internal combustion engine, said seal including:

a seal member located at a bottom portion of a valve guide, said seal member having a circumferential ring-like shape, said seal member being made of a low friction hard plastic material;

a rigid case placed over a bottom of said valve guide and in contact with a flange of the valve stem seal; and said valve guide having a reduced neck portion around an inside wall of said valve guide and a recessed shoulder portion around an outside wall of said valve guide.

2. The valve stem seal of claim 1 wherein said valve stem seal is made of a low friction fluoroethylene.

3. The valve stem seal of claim 1 wherein said valve stem seal is made of a high temperature resistant plastic material.

4. The valve stem seal of claim 1 wherein said valve stem seal is made of a polytetrafluoroethylene material.

5. The valve stem seal of claim 1 wherein said seal member has a generally L-shaped cross-section.

6. The valve stem seal of claim 1 wherein said rigid case is cylindrical and made of a metal material.

7. The valve stem seal of claim 1 further including a finger spring.

8. A valve stem seal for use in an internal combustion engine having a reciprocating valve stem, said seal including:

a seal member located at a bottom portion of a valve guide, said seal member having a circumferential ring-like shape, said seal member having an appendage located at its top inside corner, said appendage for engaging said valve stem;

a rigid cylindrical case having a flange member located at its top end, said flange of said case being in contact with the bottom of said valve guide and said seal member; and said valve guide having a first reduced neck portion, said valve guide having a second reduced neck portion, said seal member of said valve stem seal is located within said first reduced neck portion, said appendage is located within said second reduced neck portion.

9. The valve stem seal of claim 8 wherein said seal member is made of a low friction hard plastic material.

10. The valve stem seal of claim 8 wherein said seal member is made of a polybenzimidazole (PBI) material.

11. The valve stem seal of claim 8 wherein said seal member is made of a high temperature resistant plastic material.

12. The valve stem seal of claim 8 wherein said rigid case is press fitted around said valve guide.

13. The valve stem seal of claim 8 wherein said rigid case is made of harden plastic material.

14. The valve stem seal of claim 8 wherein said seal member is connected to said valve guide with a bonding agent.

15. The valve stem seal of claim 8 further including a finger spring.

* * * * *